US005775845A

United States Patent [19]

Wybro

[11] Patent Number: 5,775,845

[45] Date of Patent: Jul. 7, 1998

[54] PASSIVE RISER TENSIONER

[75] Inventor: Pieter G. Wybro, Houston, Tex.

[73] Assignees: Sea Engineering Associates, Inc., Houston, Tex.; Amclyde Engineered Products, Inc., St. Paul, Minn.

[21] Appl. No.: 784,363

[22] Filed: Jan. 17, 1997

Related U.S. Application Data

[60] Provisional application No. 60/010,204 Jan. 18, 1996.

[51] Int. Cl.[6] ..... B43B 35/44; E02B 17/00

[52] U.S. Cl. ..... 405/195.1; 166/355; 166/359; 405/224

[58] Field of Search ..... 405/195.1, 224, 405/223.1, 196–201, 224.1–224.4; 166/355, 359, 350, 367; 267/69; 175/7, 5, 27

[56] References Cited

U.S. PATENT DOCUMENTS

| | | | |
|---|---|---|---|
| 3,101,798 | 8/1963 | Wilson et al. | 166/355 |
| 3,208,728 | 9/1965 | Parks | 175/27 X |
| 3,319,981 | 5/1967 | Burgess | 166/355 X |
| 3,461,916 | 8/1969 | Ledgewood | 405/224.3 X |
| 4,379,657 | 4/1983 | Widiner et al. | 405/224.4 |
| 4,589,801 | 5/1986 | Salama | 405/223.1 |
| 4,729,694 | 3/1988 | Peppel | 405/224.4 |
| 4,808,035 | 2/1989 | Stanton et al. | 405/223.1 X |
| 4,892,444 | 1/1990 | Moore | 166/350 X |
| 5,039,255 | 8/1991 | Salama | 405/224 |
| 5,259,597 | 11/1993 | Fredheim | 267/69 |
| 5,363,920 | 11/1994 | Alexander et al. | 166/350 |

*Primary Examiner*—Dennis L. Taylor
*Attorney, Agent, or Firm*—Kenneth A. Roddy

[57] ABSTRACT

A passive riser tensioner apparatus for tensioning riser pipes on floating platforms and tension leg platforms utilizes one or more elongate elastic tensioning elements connected at top and bottom ends to the upper end of a riser pipe that are capable of being axially stretched. Each tensioning element has a threaded length adjustment rod and tension preload nut at its top end which adjusts the axial length to produce a predetermined preload tension force in the tensioning element between its connection to the riser pipe. A riser support collar slidably received on the length adjustment rod and riser pipe upper end is configured to be supported on the deck of the platform and allow axial movement of the riser pipe. A tension locking nut on the length adjustment rod releasably engages the length adjustment rod with the riser support collar when it is supported on the deck. The tension preload nut is rotated to stretch the tensioning element to produce the preload tension force prior to supporting the riser support collar on the deck. The tension locking nut is then rotated to engage the length adjustment rod with the riser support collar such that the predetermined preload tension force is transmitted between the bottom end of the tensioning element and the collar when supported on the deck. The riser is supported at its upper end by the deck and maintained in a tensioned condition by the tensioning elements while allowing a limited amount of relative movement between the deck and the riser pipe upper end.

11 Claims, 3 Drawing Sheets

PASSIVE RISER TENSIONER

BACKGROUND OF THE INVENTION

1. Field of the Invention

This invention relates generally to systems for tensioning the riser pipes on floating platforms and tension leg platforms, and more particularly to a passive riser tensioner apparatus which is integral with the upper portion of the riser pipe and has one or more elastic tensioning elements that connect the platform deck with the riser pipe.

2. Brief Description of the Prior Art

Risers pipes are tubular structures which extend from a subsea wellhead to a floating structure such as a floating platform or tension leg platform (TLP) and are used both for drilling through and producing from subsea wellheads. The risers are subjected to deflection because of the movement of the platform responsive to wind, waves, tide and currents at the surface and to movement of the riser below the surface responsive to currents. The risers are also subjected to external and internal hydrostatic pressures and axial tension applied from the floating platform to prevent buckling of the riser, to reduce the stresses in the riser, and to reduce the bending moment on the wellhead.

Floating platforms and tension leg platforms are usually provided with a connection to a riser system which may include tensioning means. Conventional tensioning means comprise a system of sheaves, wire rope, and hydraulic cylinders to maintain a relatively constant tension on the wire rope to provide the necessary upward vertical force to support the riser. Such prior art riser tensioning means are mechanical devices which are subject to wear and require continuous maintenance. The also occupy a substantial space on the platform where space is usually limited. In some riser tensioning systems floatation devices are attached adjacent to the the upper end of the riser. In such floatation tensioning systems the riser is generally exposed to wave forces which result in undesirable stresses in the riser.

Various approaches have been suggested to provide specially designed risers with improved performance. Johnson, U.S. Pat. Nos. 3,168,334 and 3,189,372 disclose risers having articulated or resilient joints. Triplett, U.S. Pat. No. 3,424,253 and Delacour et al, U.S. Pat. No. 3,538,238 disclose flexible risers. Manning, U.S. Pat. No. 3,426,859 discloses a caission which extends from the bottom to above the surface and tapers upwardly. Morgan, U.S. Pat. No. 3,605,413 discloses a riser having a varying rigidity in its lower section so that it is the stiffest at the subsea wellhead and increases in flexibility in the upward direction. Fisher et al, U.S. Pat. No. 4,188,156 discloses a riser structure which has an upper flexible steel section and a lower section formed of a more flexible material. Pierce, U.S. Pat. No. 4,634,314 discloses a riser system formed of composite materials. The specially designed riser structures and composite materials are excessively expensive, create excessive flexural laods at the wellhead or require excessively close control of the tension on the riser.

The present invention is distinguished over the prior art in general, and these patents in particular by a passive riser tensioner apparatus for tensioning riser pipes on floating platforms and tension leg platforms which utilizes one or more elongate elastic tensioning elements connected at top and bottom ends to the upper end of a riser pipe that are capable of being axially stretched. Each tensioning element has a threaded length adjustment rod and tension preload nut at its top end which adjusts the axial length to produce a predetermined preload tension force in the tensioning element between its connection to the riser pipe. A riser support collar slidably received on the length adjustment rod and riser pipe upper end is configured to be supported on the deck of the platform and allow axial movement of the riser pipe. A tension locking nut on the length adjustment rod releasably engages the length adjustment rod with the riser support collar when it is supported on the deck. The tension preload nut is rotated to stretch the tensioning element to produce the preload tension force prior to supporting the riser support collar on the deck. The tension locking nut is then rotated to engage the length adjustment rod with the riser support collar such that the predetermined preload tension force is transmitted between the bottom end of the tensioning element and the collar when supported on the deck. The riser is supported at its upper end by the deck and maintained in a tensioned condition by the tensioning elements while allowing a limited amount of relative movement between the deck and the riser pipe upper end.

SUMMARY OF THE INVENTION

It is therefore an object of the present invention to provide a passive riser tensioner apparatus for tensioning riser pipes on floating platforms and tension leg platforms which will produce a predetermined preload tension force at the upper end of the riser pipe before it is connected to the platform deck.

It is another object of this invention to provide a passive riser tensioner apparatus for tensioning riser pipes on floating platforms and tension leg platforms which will allow the riser to be supported at its upper end by the deck of the platform while maintained in a tensioned condition and allow a limited amount of relative movement between the deck and the riser pipe upper end.

Another object of this invention is to provide a passive riser tensioner apparatus for tensioning riser pipes on floating platforms and tension leg platforms which does not require hydraulic, pneumatic, or complex mechanical mechanism to produce a tensioned condition in the riser.

Another object of this invention is to provide a passive riser tensioner apparatus for tensioning riser pipes on floating platforms and tension leg platforms which utilizes one or more elongate elastic tensioning elements to support the upper end of the riser and maintain it in a tensioned condition while allowing a limited amount of relative movement between the deck and the riser pipe upper end.

Another object of this invention is to provide a passive riser tensioner apparatus that utilizes one or more elongate elastic tensioning elements which are easily and quickly installed and removed.

A further object of this invention is to provide a passive riser tensioner apparatus that utilizes one or more elongate elastic tensioning elements wherein the individual elastic tensioning elements may be easily and quickly replaced while the the upper end of the riser is maintained in a tensioned condition.

A still further object of this invention is to provide a passive riser tensioner apparatus which is simple in construction, inexpensive to manufacture, and is rugged and reliable in operation.

Other objects of the invention will become apparent from time to time throughout the specification and claims as hereinafter related.

The above noted objects and other objects of the invention are accomplished by a passive riser tensioner apparatus for tensioning riser pipes on floating platforms and tension leg platforms which utilizes one or more elongate elastic tensioning elements connected at top and bottom ends to the upper end of a riser pipe that are capable of being axially stretched. Each tensioning element has a threaded length adjustment rod and tension preload nut at its top end which adjusts the axial length to produce a predetermined preload tension force in the tensioning element between its connection to the riser pipe. A riser support collar slidably received on the length adjustment rod and riser pipe upper end is configured to be supported on the deck of the platform and allow axial movement of the riser pipe. A tension locking nut on the length adjustment rod releasably engages the length adjustment rod with the riser support collar when it is supported on the deck. The tension preload nut is rotated to stretch the tensioning element to produce the preload tension force prior to supporting the riser support collar on the deck. The tension locking nut is then rotated to engage the length adjustment rod with the riser support collar such that the predetermined preload tension force is transmitted between the bottom end of the tensioning element and the collar when supported on the deck. The riser is supported at its upper end by the deck and maintained in a tensioned condition by the tensioning elements while allowing a limited amount of relative movement between the deck and the riser pipe upper end.

DESCRIPTION OF THE PREFERRED EMBODIMENT

The present riser tensioner apparatus is used for tensioning the riser pipes on floating platforms and, particularly tension leg platforms (TLPs). The riser pipe is the critical element between the seafloor and the floating platform the transports fluids or provides a conduit passage of tools and other devices. The present riser tensioner apparatus is a reliable means for attaching and tensioning the riser to the platform and provides adequate tensioning capacity and stroke over the required operating conditions of the riser.

Figure 1:
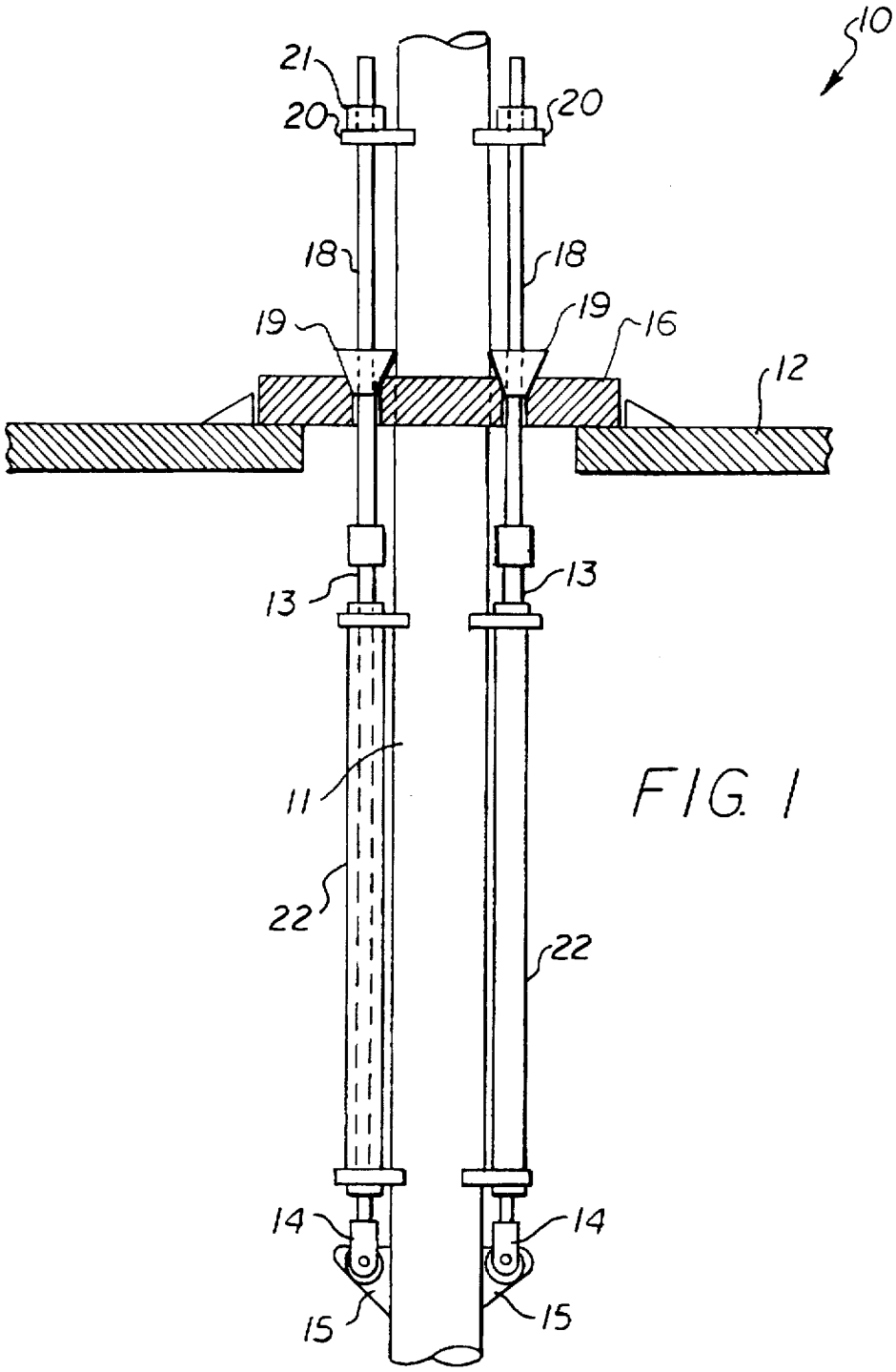
FIG. 1 is a side elevation of the upper portion of a riser pipe connected to the deck of a floating platform, showing the passive riser tensioner apparatus in accordance with the present invention.
Figure 2:
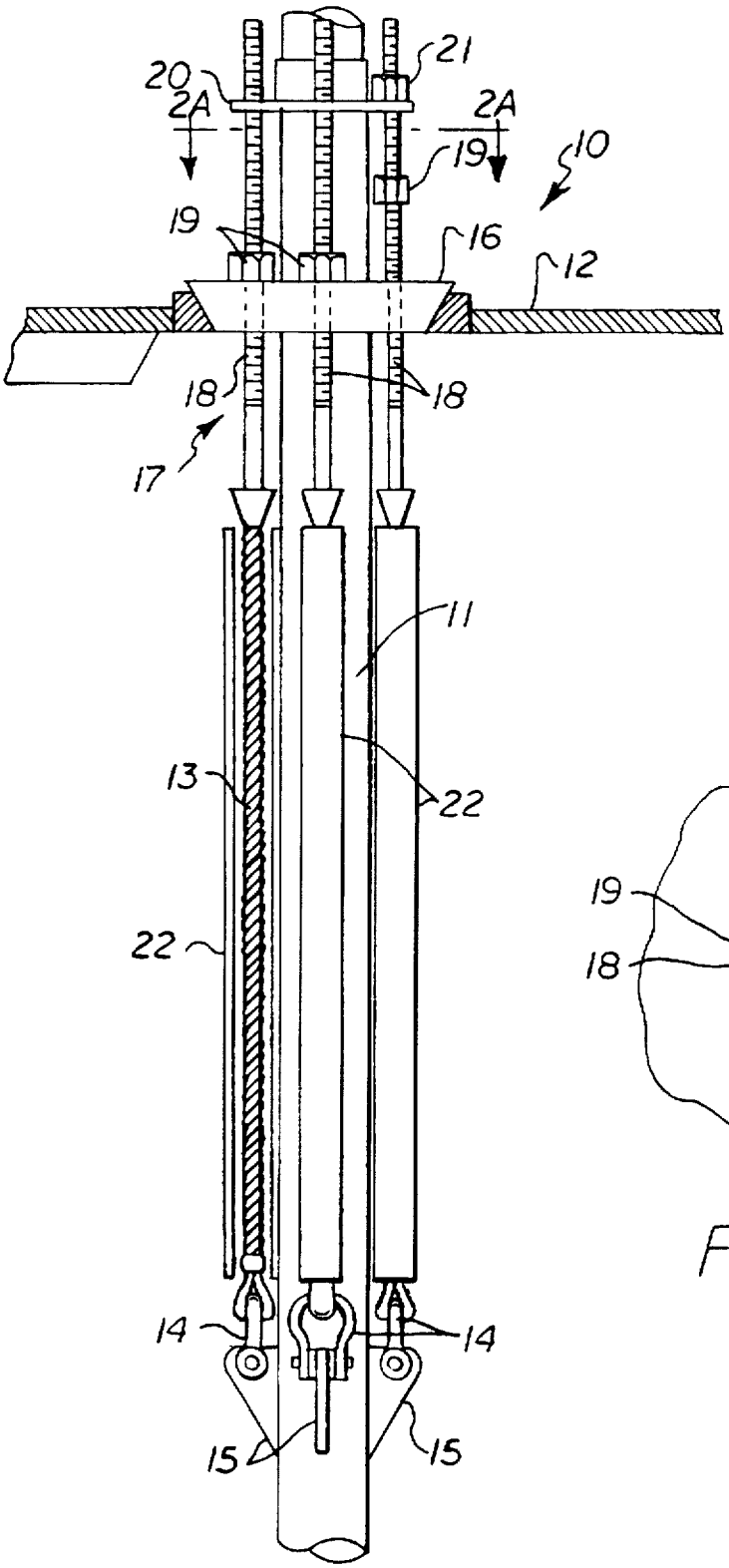
FIG. 2 is a side elevation of the upper portion of a riser pipe connected to the deck of a floating platform, showing the passive riser tensioner apparatus in greater detail and showing a threaded nut used as the length adjustment device.
Figure 2A:
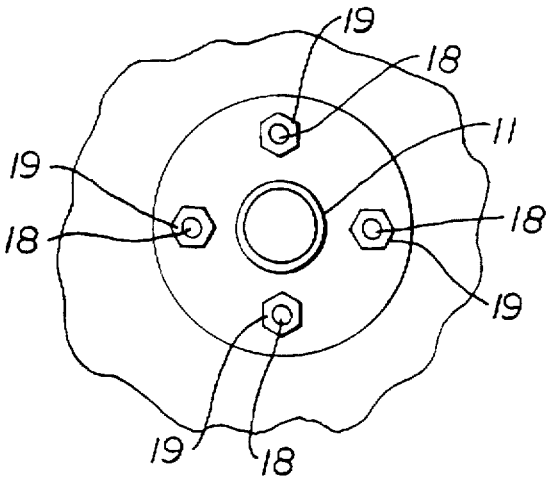
FIG. 2A is a top plan view of the passive riser tensioner apparatus taken along line 2A—2A of FIG. 2.

Referring to the drawings by numerals of reference, a preferred passive riser tensioner apparatus 10 in accordance with the present invention is shown somewhat schematically in FIG. 1, and in greater detail in FIG. 2.

FIGS. 1 and 2 show the upper portion of a riser 11 connected to the deck 12 of a floating platform. Two riser tensioners 10 are shown in FIG. 1 and four riser tensioners are shown in FIG. 2, however, it should be understood than any number (one or more) may be used.

Each riser tensioner 10 has an elongate individual tensioning element, such as a spring or synthetic rope stretcher 13 which is attached at its lower end to the riser 11 a distance below the deck 12 of the floating platform. This distance is dictated by the required length of the spring or synthetic rope stretcher 13, and the required stroke distance.

In the illustrated example of the preferred embodiment, the lower end of each spring or synthetic rope stretcher 13 is attached by a shackle 14 to a pad eye 15 that is secured to the riser 11. However, it should be understood that a load ring or other conventional means of attachment may be used for attaching the lower end of the spring or synthetic rope stretcher 13 to the riser 11.

The upper end of each spring or synthetic rope stretcher 13 is attached to a support collar 16 by an individual length adjustment device 17 secured to the top end of the spring or synthetic rope stretcher 13. The support collar 16 is attached to the deck 12 of the floating platform.

As best seen in FIG. 2, each individual length adjustment device 17 has an externally threaded adjustment rod 18 which extends upwardly from the top end of the spring or synthetic rope stretcher 13 and through the support collar 16 and has a tensioner nut 19 threadedly engaged thereon above the support collar. The upper end of each adjustment rod 18 passes through a radially extending preload flange 20 which is secured to the riser 11 above the support collar 16, and a preload nut 21 is threadedly engaged on the upper end of the adjustment rod 18 above the preload flange.

It should be underestood that other length adjustment devices may be used in place of the threaded rod 18 and tensioner nut 19. For example, the adjustment rod 18 may have a smooth surface and gripper wedges or other gripping devices may be used for gripping the adjustment rod, and stretching or preloading the springs or synthetic rope stretchers 13 may be accomplished by winches and/or hydraulic cylinders.

In the preferred embodiment each spring or synthetic rope stretcher 13 is disposed in an individual tubular housing or shroud 22 which is secured to the exterior of the riser 11 by conventional means such as welding. The housings or shrouds 22 serve to protect the springs or synthetic rope stretchers 13, and also to provide lateral support to prevent buckling of the upper portion of the riser above the load ring or pad eyes 15 due to compression in the riser in this area.

When the required riser tension is known, the springs or synthetic rope stretchers 13 are preloaded to a predetermined amount of tension by the individual length adjustment devices 17 prior to deployment of the riser 11.

As best seen in FIG. 2, preloading of the springs or synthetic rope stretchers 13 is acheived by setting a known tension at the top of the adjustment rods 18 of the individual length adjustment devices 17 by running the preload nuts 21 down against the preload flange 20 secured to the riser 11. The tension force is transmitted between the lower attachment point (load ring or pad eyes 15) of the springs or synthetic rope stretchers 13 and their connection at the preload flange 20 at their upper ends. At this point in time, the tensioner nuts 19 are in a backed-off or retracted position above the support collar 16 such that the support collar is slidably retained on the threaded adjustment rods 18.

After the riser 11 is deployed and connected to the seabed, the support collar 16 is lowered on the threaded adjustment rods 18, and landed onto the deck 12 of the platform. Each threaded adjustment rod 18 is then engaged onto the support collar 16 by running the tensioner nuts 19 down on the threaded adjustment rods 18 to engage the top of the support collar, and the preload nuts 21 at the top of the adjustment rods are released (backed-off). The preload tension force is now transmitted between the lower attachment point (load ring or pad eyes 15) of the springs or synthetic rope stretchers 13 and their connection to the support collar 16 attached to the deck 12 of the platform.

Gimbal action of the riser 11 can be accomodated by providing self-aligning (spherical) bushings at the attachment of the tensioner nuts 19 to the support collar 16. This allows the individual length adjustment devices 17 to rotate as the riser rotates.

Each of the springs or synthetic rope stretchers 13 can be replaced while the riser tensioner apparatus is in service, provided that two or more of the springs or synthetic rope stretchers 13 are used.

The springs or synthetic rope stretchers 13 are replaced by first slacking the load on the spring or synthetic rope stretcher to be replaced, then releasing its lower end from the load ring or pad eye 15 (or other attachment means) that connects it to the riser 11, disconnecting the threaded adjustment rod 18 from the top end of the spring or stretcher, and pulling it out of its tubular housing or shroud 22. The replacement spring or stretcher 13 is then lowered into the tubular housing or shroud 22, connected at its top end to the threaded adjustment rod 18 and connected at its lower end to the load ring or pad eye 15 (or ather attachment means). The replacement spring or synthetic rope stretcher 13 is then tensioned by running the preload nut 21 down against the preload flange 20 secured to the riser 11, and the threaded adjustment rod 18 is engaged onto the support collar 16 by running the tensioner nut 19 down on the adjustment rod to engage the top of the support collar.

Figure 3:
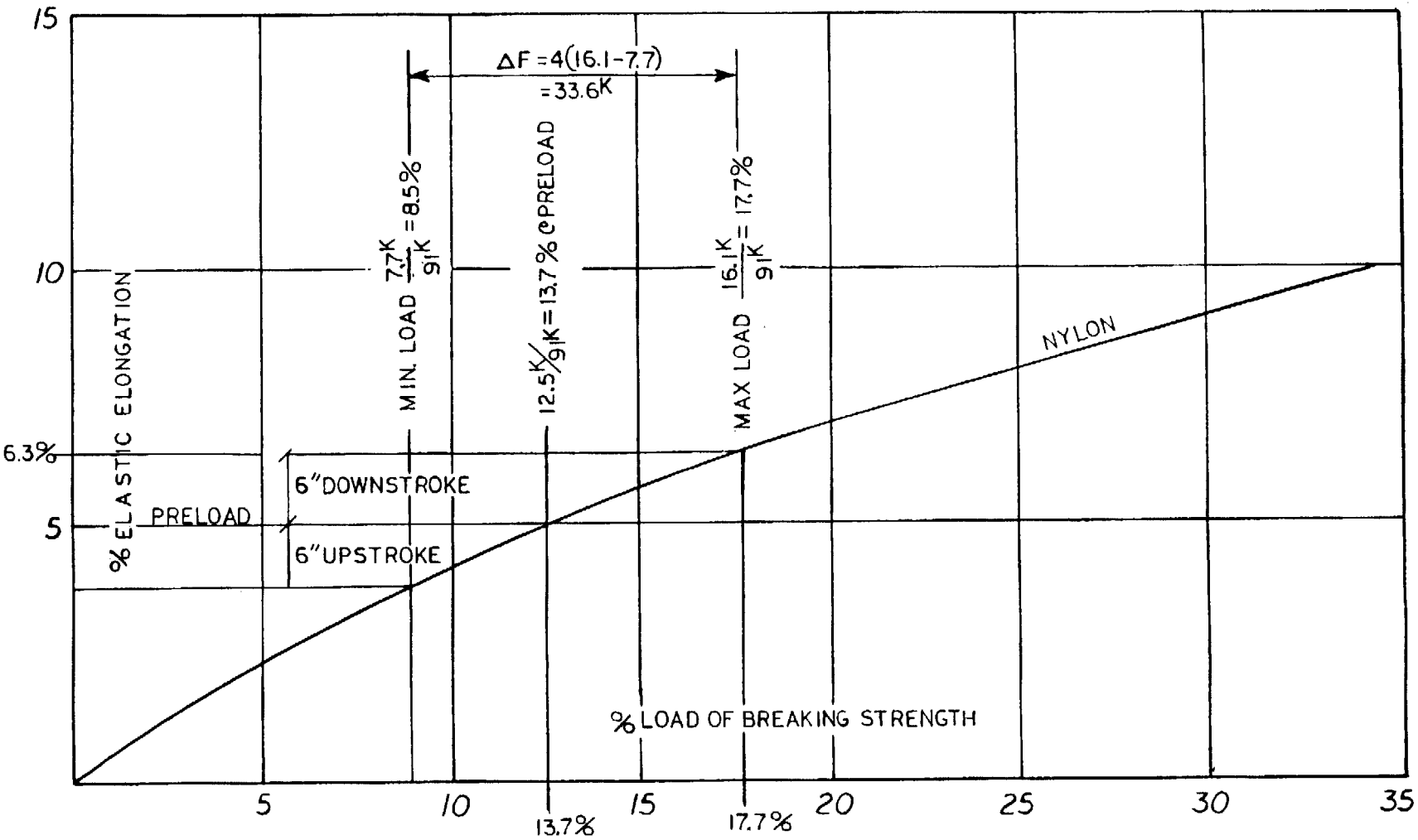
FIG. 3 is a graph illustrating the load-elongation characteristics and the percentage load of breaking strength of a synthetic stretcher element.

Referring now to the chart of FIG. 3, an example of a typical installation will be described using a riser tension of 50 kips (preload value) which is to have +/−6 inches of stroke with no more than +/−17 kips of tension variation.

In this example, there are four individual tensioning devices each utilizing a synthetic rope stretcher such as a nylon rope. Each rope has a 5 inch circumference, 91 kip breaking strength, and elastic characteristics as shown in the chart.

Each synthetic rope stretcher is preloaded to 12.5 kips, which is 13.7% of the breaking strength. The preload elongation is 5%, and the synthetic ropes are 37 feet long. The elastic characteristics of the synthetic ropes over their operating range is approximately 0.33% elongation per % breaking load. The synthetic ropes will stretch about 1.85 feet at preload, and will operate at a minimum of 7.7 kips (8.5% breaking load) and at a maximum of 16.1 kips (17.7% breaking load) due to the +/−6 inch stroking.

While this invention has been described fully and completely with special emphasis upon a preferred embodiment, it should be understood that within the scope of the appended claims the invention may be practiced otherwise than as specifically described herein.

I claim:

1. A passive riser tensioner apparatus for tensioning riser pipes on floating platforms and tension leg platforms, comprising:

at least one elongate elastic tensioning element connected at a bottom end to an upper end of a riser pipe to extend generally parallel thereto and capable of being axially stretched to produce a tension force along its length;

length adjustment means connected with a top end of said tensioning element for adjusting its axial length to produce a predetermined preload tension force in said tensioning element between its connection to said riser pipe upper end at said top and bottom ends;

riser support means slidably received on said length adjustment means and said riser pipe upper end configured to be supported on the platform and allow axial movement of said riser pipe upper end;

tension locking means connected with said length adjustment means to releasably engage said length adjustment means with said riser support means when supported on said platform;

said length adjustment means being operative to stretch said tensioning element to produce said preload tension force prior to supporting said riser support means on said platform; and said tension locking means being operative to engage said length adjustment means with said riser support means such that said predetermined preload tension force is transmitted between said bottom end of said tensioning element and said riser support means when supported on said platform, whereby said riser is supported at its upper end by said platform and maintained in a tensioned condition by said tensioning element while allowing a limited amount of relative movement between said platform and said riser pipe upper end.

2. The passive riser tensioner apparatus according to claim 1 in which there are at least two said elongate elastic tensioning elements each connected at top and bottom ends to said riser pipe upper to extend generally parallel thereto in circumferentially spaced relation.

3. The passive riser tensioner apparatus according to claim 1 wherein said elongate elastic tensioning element comprises a length of synthetic rope.

4. The passive riser tensioner apparatus according to claim 1 wherein said elongate elastic tensioning element comprises a tension spring.

5. The passive riser tensioner apparatus according to claim 1 wherein said tensioning element is releasably connected at said top and bottom ends to said riser pipe upper end.

6. The passive riser tensioner apparatus according to claim 1 further comprising a hollow tubular housing secured to said riser pipe upper end to extend generally parallel thereto and substantially surround said tensioning element.

7. The passive riser tensioner apparatus according to claim 1 wherein said length adjustment means comprises a radially extending upper load bearing member secured to said riser pipe upper end;

an elongate rod on said tensioning element top end which extends slidably through said upper load bearing member; and gripping means engaged on said rod above said load bearing member and being operative to support said rod and allow stretching of said tensioning element to increase said preload tension force in each said tensioning element and to allow said tensioning element to contract and reduce said preload tension force.

8. The passive riser tensioner apparatus according to claim 1 wherein said length adjustment means comprises a radially extending upper load bearing member secured to said riser pipe upper end;

an elongate externally threaded rod on said tensioning element top end which extends slidably through said upper load bearing member; and an upper nut threadedly engaged on said threaded rod above said upper load bearing member;

said upper nut when rotated in a first direction stretching said tensioning element to increase said preload tension force in each said tensioning element and when rotated in an opposite direction allowing said tensioning element to contract and reduce said preload tension force.

9. The passive riser tensioner apparatus according to claim 8 wherein said riser support means comprises a support plate having a top surface and a bottom surface, a central bore through which said riser pipe upper end slidably extends, and a hole radially spaced therefrom through which said elongate externally threaded rod slidably extends.

10. The passive riser tensioner apparatus according to claim 9 wherein said tension locking means comprises a lower nut threadedly engaged on said threaded rod above said support plate;

said lower nut when rotated in a first direction allows said support plate to slide vertically relative to said riser pipe upper end and said elongate threaded rod and when rotated in an opposite direction said lower nut engages said support plate top surface and said support plate bottom surface is biasly engaged on said deck by said tension force in said tensioning element and said tension force is transmitted between the connection of said bottom end of said tensioning element with said riser pipe upper end and said support plate.

11. A method for tensioning the riser pipes on floating platforms and tension leg platforms comprising the steps of:

providing at least one elongate elastic tensioning element having top and bottom ends and capable of being axially stretched to produce a tension force along its length between said top and bottom ends, said tensioning element having length adjustment means at said top end and tension locking means connected with said length adjustment means;

providing riser support means slidably disposed on said length adjustment means and the upper end of a riser pipe, said riser support means configured to be supported on the deck of the platform and allow axial movement of said riser pipe upper end;

connecting said tensioning element at said top and bottom ends to said riser pipe upper end to extend parallel thereto;

adjusting the axial length of said tensioning element to stretch it thereby producing a predetermined preload tension force in said tensioning element between its connection to said riser pipe upper end at said top and bottom ends;

supporting said riser support means on the deck of the platform;

engaging said tension locking means and said length adjustment means with said riser support means such that said predetermined preload tension force is transmitted between said bottom end of said tensioning element and said riser support means when supported on said deck, whereby said riser is supported at its upper end by said deck and maintained in a tensioned condition by said tensioning element while allowing a limited amount of relative movement between said deck and said riser pipe upper end.

* * * * *